US008496430B2

(12) United States Patent
Kilminster

(10) Patent No.: US 8,496,430 B2
(45) Date of Patent: Jul. 30, 2013

(54) VARIABLE STATOR BLADE ASSEMBLY

(75) Inventor: Darren Kilminster, Shepshed (GB)

(73) Assignee: Siemens Aktiengesellschaft, München (DE)

( * ) Notice: Subject to any disclaimer, the term of this patent is extended or adjusted under 35 U.S.C. 154(b) by 868 days.

(21) Appl. No.: 12/515,587

(22) PCT Filed: Sep. 11, 2007

(86) PCT No.: PCT/EP2007/059490

§ 371 (c)(1),
(2), (4) Date: Jan. 15, 2010

(87) PCT Pub. No.: WO2008/061825

PCT Pub. Date: May 29, 2008

(65) Prior Publication Data

US 2010/0111677 A1 May 6, 2010

(30) Foreign Application Priority Data

Nov. 22, 2006 (EP) ..... 06024240

(51) Int. Cl.
*F04D 29/46* (2006.01)

(52) U.S. Cl.
USPC ..... 415/160

(58) Field of Classification Search
USPC ..... 415/151, 159, 160, 161, 162, 208.1, 415/208.2
See application file for complete search history.

(56) References Cited

U.S. PATENT DOCUMENTS

| | | | | |
|---|---|---|---|---|
| 2,919,890 | A | 1/1960 | Smith et al. | |
| 3,887,731 | A | 6/1975 | Dean et al. | |
| 4,277,221 | A * | 7/1981 | Kanger | 415/160 |
| 4,792,277 | A * | 12/1988 | Dittberner et al. | 415/160 |
| 4,828,403 | A * | 5/1989 | Schwartzman | 384/100 |
| 5,324,165 | A * | 6/1994 | Charbonnel et al. | 415/160 |
| 5,807,072 | A | 9/1998 | Payling | |
| 6,161,834 | A | 12/2000 | Pollack et al. | |
| 6,170,990 | B1 * | 1/2001 | Hawkins | 384/297 |
| 6,468,028 | B1 * | 10/2002 | Rockwood | 415/58.4 |
| 7,798,496 | B2 * | 9/2010 | Dietle et al. | 277/551 |
| 2005/0220609 | A1 * | 10/2005 | Foucher et al. | 415/160 |
| 2006/0110246 | A1 * | 5/2006 | Bruce | 415/160 |
| 2007/0128447 | A1 * | 6/2007 | Hazel et al. | 428/426 |

FOREIGN PATENT DOCUMENTS

| | | |
|---|---|---|
| CA | 2371537 | 8/2002 |
| FR | 2570133 | 3/1986 |
| JP | 11248003 A | 9/1999 |
| JP | 2002267021 A | 9/2002 |

OTHER PUBLICATIONS

RD 393053 A, Jan. 10, 1997, Darling et al.
"Polon PTFE Sealing Solutions & capabilities", Parker engineered polymer systems; 2002, pp. XP002433141; Chicago.
OmniSeal HANDBOOK, 2003, Sain-Bobain Performance Plastics; OmniSeal HANDBOOK; XP002433140 pp. 6,11,15-20,41; Kontich.

* cited by examiner

*Primary Examiner* — Edward Look
*Assistant Examiner* — Liam McDowell

(57) ABSTRACT

A variable stator blade assembly of a compressor, in particular of a gas turbine, including a compressor casing with a counterbore and a receptacle, a stator blade with a spindle, a spindle bush and a seal is provided. The spindle bush is placed inside the receptacle and spindle is placed inside the spindle bush wherein the seal is placed radially between the spindle and the spindle bush. The spindle is the dynamic seal face and a face within the spindle bush is the static seal face.

15 Claims, 2 Drawing Sheets

VARIABLE STATOR BLADE ASSEMBLY

CROSS REFERENCE TO RELATED APPLICATIONS

This application is the US National Stage of International Application No. PCT/EP2007/059490, filed Sep. 11, 2007 and claims the benefit thereof. The International Application claims the benefits of European Patent Office application No. 06024240.1 EP filed Nov. 22, 2006, both of the applications are incorporated by reference herein in their entirety.

FIELD OF INVENTION

The invention relates to a variable stator blade assembly of a compressor, in particular of a gas turbine.

BACKGROUND OF INVENTION

In a gas turbine a compressor produces compressed air which is directed into a combustor. In the combustor the compressed air is mixed with fuel and burnt. The hot and pressurized gas exiting from the combustor passes through a turbine to drive a respective rotor.

In operation air is drawn into the staged compressor. Each stage of the compressor comprises a row of stator blades and rotor blades. The first rows of stator blades can be implemented as variable stator blades which are adjusted by actuation levers. The stator blades deflect the incoming air and direct it onto the airfoils of the rotor blades for compression. The variation of the stator blades allows for load changes of the gas turbine.

In such compressors, measures have to be taken to prevent compressor blade spindle seizure. For example, seized out of position stator blades can cause turbulent effect on adjacent downstream stages of rotor blades, possibly accelerating cyclic fatigue of the rotor blades. Another issue that is to be addressed is that overloading and subsequent bending of one or many variable compressor blade actuation levers can occur. Individual variable compressor blade stage push rods can be overloaded and subsequently bended. Finally, the engine can trip to idle speed due two out of position blades. Also, a combination of these issues can take place.

In FIGS. 1 and 2 prior art assemblies of variable stator blades are shown. FIG. 1 shows a variable stator blade 2 with a spindle 4 and sections 5, 7, 9 and 11.

The spindle 4 is placed inside a bearing bush 10 which is placed in turn within a spindle bush 8. The spindle bush 8 is surrounded by a casing 6 with a counterbore 18. The section 9 holds a seal 12 with adjacent o-rings 14 on sections 7 and 11. Between the spindle bush 8 and the o-ring 14 on section 7 there is a thrust washer 16.

Wear to the seal edge 13 of the seal 12 can cause reduction of sealing between the casing 6 and the variable stator blade 2.

In FIG. 2, another arrangement of a variable stator blade assembly is shown. The arrangement is substantially the same as in FIG. 1. Here, no seal 12 is present. Instead, the sealing is achieved by an o-ring 14 placed between the section 7 of the compressor blade 2 and the thrust washer 16.

In this arrangement moisture can enter the counterbore 18 from the gap 17 between counterbore wall of the casing 6 and the compressor blade 2 if the sealing fails.

To provide a seal between a rotating part and a stationary part, several types of seals are known. Some of theses seals are disclosed in U.S. Pat. No. 6,161,834, JP 11248003, CA 2371537, JP 2002267021 and RD 393053.

OBJECTIVE OF THE INVENTION

The objective of the invention is to provide an improved variable stator blade assembly for a gas turbine compressor. Another objective is to provide an improved compressor.

Solution According to the Invention

These objectives are solved by a variable stator blade assembly and by a compressor. The depending claims define further developments of the invention.

An inventive variable stator blade assembly comprises a compressor casing with a counterbore, a receptacle, a stator blade with a spindle, a spindle bush and a seal. The spindle bush is placed inside the receptacle and the spindle is placed inside the spindle bush. The seal is placed radially between the spindle and the spindle bush with the spindle as the dynamic seal face and a face within the spindle bush as the static seal face. At least one bearing bush may be placed between the spindle bush and the spindle.

Compared to state of the art variable stator blade assemblies of compressors of gas turbines no casing or blade modifications are required. O-rings or solid PTFE seals are also not required. The assembly allows for a simplified blade platform introduction. A change of the spindle bush and seals on site is possible. The seal operates on the smallest seal area within the assembly.

The blade spindle is the smoothest surface finished component within the assembly. As this face is ground as the bearing face, using it as the seal face incurs no extra surface preparation costs.

As the face of the spindle bush is usually a machined face, it is of high surface finish but is not required to be as smooth as the dynamic seal face. So cost is not incurred trying to obtain very smooth finish.

One advantageous development of the invention is that the seal is a spring energized low friction seal. This provides a tight sealing between the spindle and the spindle bush.

In another advantageous development of the invention the energized seal seals axially. In this case the axial seal is insensitive to the axial float that is present within the assembly to allow smooth, free operation of the blade within its bearings.

The energized seal can also be a radial seal, which has a smaller circumference than an axial seal.

In another advantageous development of the invention the energized seal has non-corroding energizing springs. The energizing spring pushes the seal hard against the seal faces. This self-aligns the seal between the two components being sealed, compensates for temperature growth of components being sealed and also any slight seal wear over time. The spring can be made of steel.

In another advantageous development of the invention the energized seal jacket is PTFE which is of a very low friction coefficient. So seals induce minimum stiction or friction to the operation of the blade.

Furthermore, the energized seal jacket can be PTFE with a filler material to enhance certain properties, as for example flexibility.

In another advantageous development of the invention the energized seals is of an open C-profile with the open end on the high pressure side of the seal. As the pressure increases within the compressor the seal will be pushed harder against the seal faces improving sealing further still.

The blade assembly can be provided with only one energized seal saving assembly costs.

In another advantageous development of the invention the counterbore within in the compressor casing has its surface coated with an anti-corrosion coating. The anti-corrosion coating is provided as for the rest of the compressor gas washed faces (e.g. packed aluminum coating, used in the casing anyway). This will prevent any corrosion of the casing within this area. The tolerance on the counterbore is also not required to be tightly controlled as the counterbore is not required to perform as a seal face for any seals.

Advantageously, a compressor of a gas turbine is equipped with a variable stator blade assembly according to the present invention.

Further features, characteristics and advantages of the invention become clear from the following description of the embodiments and reference to the accompanying drawings.

DETAILED DESCRIPTION OF THE EMBODIMENT

Figure 3:
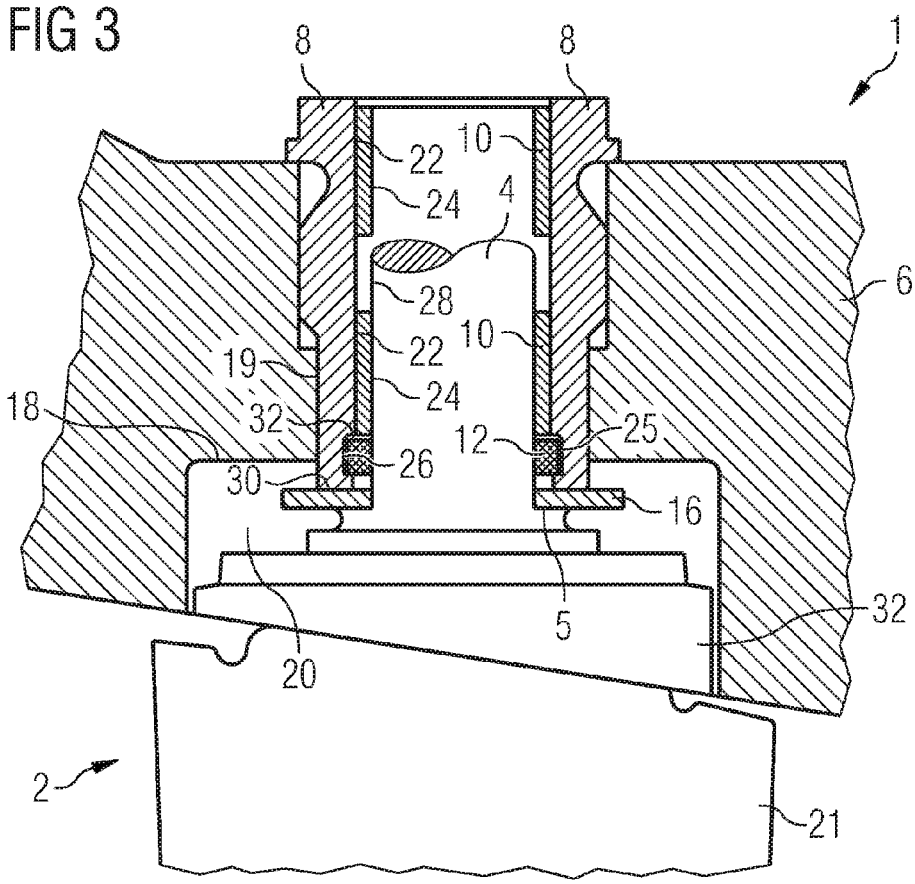
FIG. 3 shows a sealing arrangement of a variable stator blade assembly

FIG. 3 shows a variable stator blade assembly of a compressor 1 comprising a casing 6 with a counterbore 18 and a receptacle 19, a compressor blade 2 with an airfoil portion 21, a spindle 4, an intermediate portion 32 with a section 5, a thrust washer 16, and a sealing arrangement. The sealing arrangement comprises a spindle bush 8, bearing bushes 10 and a seal 12.

A plurality of counterbores 18 is placed on the inner circumference of the annular casing 6 of the compressor. One receptacle 19 at a time connects to each of the counterbores 18. Each receptacle 19 is adjacent and concentric to the respective counterbore 18 and is thus directed towards the outer radius of the annular casing 6.

The spindle 4 is an elongated portion of the compressor blade 2 extending in a radial direction towards the outside of the compressor casing 6 when assembled as described below. The spindle 4 comprises an outer surface 28. Between the airfoil portion 21 of the compressor blade 2 and the spindle 4 the intermediate portion 32 with the section 5 is present.

Further the compressor blade assembly comprises a conventional flat ringshaped thrust washer 16 with a concentric hole.

The spindle bush 8 of the sealing arrangement is formed such that its outer shape fits into the receptacle 19. The inner shape of the spindle bush 8 is straight where it receives the bearing bushes 10 and comprises a recess 25 with an inner surface 26 where the seal 12 is to be fitted. The spindle bush further comprises an axial face 30 facing towards the inside of the compressor casing 6.

The bearing bushes 10 are made of straight cylindrical material. The bearing bushes 10 each comprise an outer surface 22 and an inner surface 24.

The spindle bush 8 is inserted into the receptacle 19 from the outside of the casing 6. The two bearing bushes 10 are placed parallel inside the spindle bush 8 with the outer surfaces 22 of the bearing bushes 10 contacting the inner surface 26 of the spindle bush 8.

The intermediate portion 32 of the blade 2 is located inside the counterbore 18. The spindle 4 of the blade 2 is placed inside the bearing bushes 10 from the inside of the casing 6 such that inner surfaces 24 of the bearing bushes 10 contact the outer surface 28 of the spindle 4. Hence, the spindle is also located inside the spindle bush 8.

Figure 4:
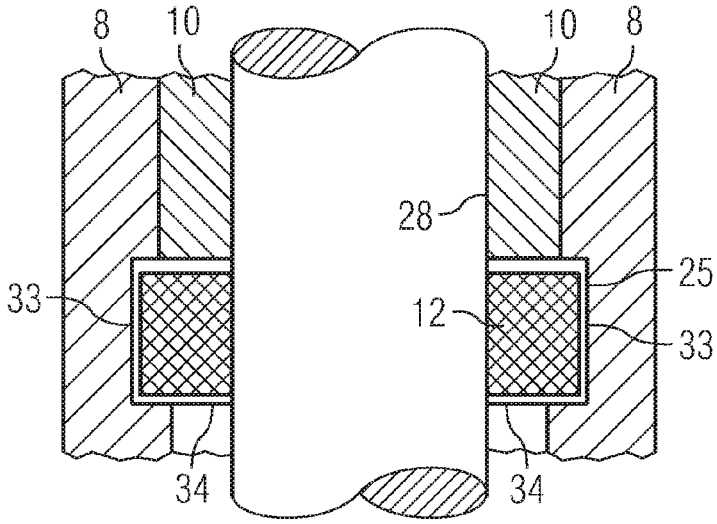
FIG. 4 shows a detailed view of the sealing arrangement

Between the spindle bush 8 and the spindle 4 there is the seal 12 sealing between the inner surface 26 of the recess 25 of the spindle bush 8 and the outer surface 28 of the spindle 4. The seal 12 is ring-shaped and can be implemented as a radial or axial seal. It can be made of Polytetrafluoroethylene (PTFE) and comprise a spring. The spring can be made of steel or any other non-corroding springy material. The seal shown in detail in FIG. 4 may be an axial or a radial seal. When sealing radially, the seal 12 seals between the outer surface of the spindle 28 and the radial sealing surface 33 of the spindle bush 8. In the case of axial sealing, the seal 12 contacts the outer surface of the spindle 28 and the axial sealing surface 34 of the spindle bush 8.

Figure 1:
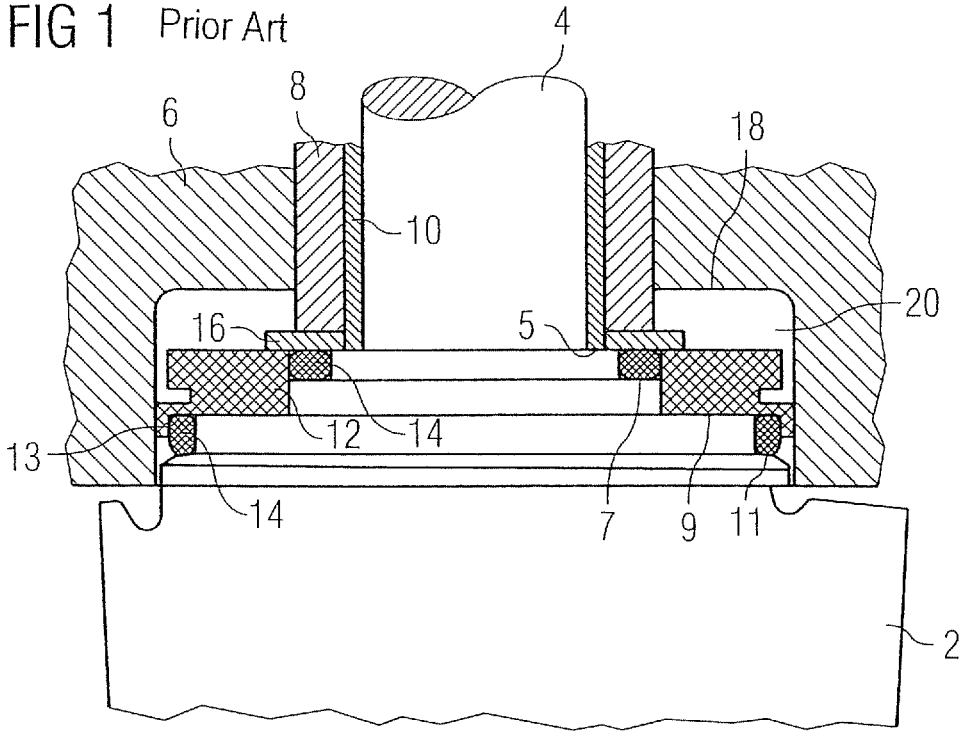
FIG 1 Prior Art
FIG. 1 shows a first sealing arrangement according to the state of the art
Figure 2:
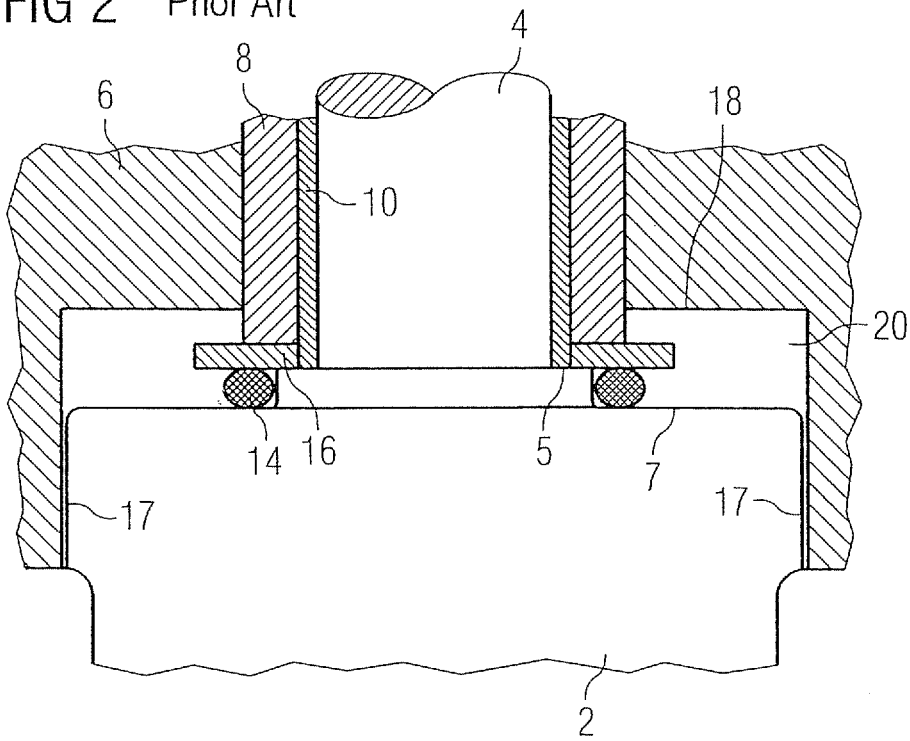
FIG 2 Prior Art
FIG. 2 shows a second sealing arrangement according to the state of the art

As in FIGS. 1 and 2, the thrust washer 16 is placed between an axial face 30 of the spindle bush 8 and the section 5 of the compressor blade 2.

In operation, the stator blade 2 is rotated around the rotational axis of the spindle 4 by a lever (not shown). The seal 12 is provided to prevent water and dirt or rust from the spacing 20 in the counterbore 18 to enter the gaps between the spindle 4 and the bearing bushes 10 as well as the bearing bushes 10 and the spindle bush 8.

The invention claimed is:

1. A variable stator blade assembly of a compressor, comprising:

a compressor casing with a counterbore;

a receptacle;

a stator blade with a spindle;

a spindle bush; and a single ring-shaped seal, wherein the spindle bush is inserted inside the receptacle and the spindle is placed inside the spindle bush, wherein the seal is placed radially between the spindle and the spindle bush, wherein the spindle is a dynamic seal face and a face within the spindle bush is a static seal face, wherein a bearing bush is placed between the spindle bush and the spindle, and wherein a recess is provided in the spindle bush, and not on the spindle itself, which accommodates the seal.

2. The variable stator blade assembly as claimed in claim 1, wherein the seal is a spring energized, low friction seal.

3. The variable stator blade assembly as claimed in claim 1, wherein the seal is an axial seal.

4. The variable stator blade assembly as claimed in claim 1, wherein the seal is a radial seal.

5. The variable stator blade assembly as claimed in claim 1, wherein the seal comprises a jacket made from polytetrafluoroethylene.

6. The variable stator blade assembly as claimed in claim 5, wherein the seal jacket is made of polytetrafluoroethylene with a filler material.

7. The variable stator blade assembly as claimed in claim 1, wherein the seal is an open C-profile with an open end on a high pressure side of the seal.

8. The variable stator blade assembly as claimed in claim 1, wherein a surface of the counterbore is coated with an anti-corrosion coating.

9. The variable stator blade assembly as claimed in claim 1, wherein the variable stator blade assembly is in a gas turbine.

10. A compressor of a gas turbine, comprising:

a variable stator blade assembly, comprising:

a compressor casing with a counterbore, a receptacle, a stator blade with a spindle, a spindle bush; and a single ring-shaped seal, wherein the spindle bush is inserted inside the receptacle and the spindle is placed inside the spindle bush, wherein the seal is placed radially between the spindle and the spindle bush, wherein the spindle is a dynamic seal face and a face within the spindle bush is a static seal face, wherein a bearing bush is placed between the spindle bush and the spindle, and wherein a recess is provided in the spindle bush, and not on the spindle itself, which accommodates the seal.

11. The compressor of a gas turbine as claimed in claim 10, wherein the seal is a spring energized, low friction seal.

12. The compressor of a gas turbine as claimed in claim 10, wherein the seal is an axial seal.

13. The compressor of a gas turbine as claimed in claim 10, wherein the seal is a radial seal.

14. The compressor of a gas turbine as claimed in claim 10, wherein the seal comprises a jacket made from polytetrafluoroethylene.

15. The compressor of a gas turbine as claimed in claim 14, wherein the seal jacket is made of polytetrafluoroethylene with a filler material.

* * * * *